United States Patent [19]

Ketterer

[11] 3,999,877

[45] Dec. 28, 1976

[54] NEEDLE FOR BLIND STITCH SEWING

[75] Inventor: Stanley J. Ketterer, Jamesburg, N.J.

[73] Assignee: The Singer Company, New York, N.Y.

[22] Filed: Apr. 7, 1975

[21] Appl. No.: 565,917

Related U.S. Application Data

[62] Division of Ser. No. 527,315, Nov. 26, 1974, Pat. No. 3,908,569.

[52] U.S. Cl. ..... 112/227

[51] Int. Cl.[2] ..... D05B 55/06; D05B 85/00

[58] Field of Search ..... 112/222, 223, 224, 225, 112/227; 223/99, 102

[56] References Cited

UNITED STATES PATENTS

| | | | |
|---|---|---|---|
| 112,980 | 3/1871 | Strain | 112/224 |
| 471,972 | 3/1892 | Hall | 112/224 |
| 1,115,469 | 10/1914 | Lipe | 112/223 |
| 3,699,911 | 10/1972 | Ketterer | 112/224 |

*Primary Examiner*—George H. Krizmanich
*Attorney, Agent, or Firm*—Robert E. Smith; Marshall J. Breen; Chester A. Williams, Jr.

[57] ABSTRACT

A latch needle is disclosed with a sliding bolt of unique construction which is easily manufacturable and which serves with particular effectiveness in accordance with this invention in carrying out blindstitch sewing.

1 Claim, 5 Drawing Figures

NEEDLE FOR BLIND STITCH SEWING

This is a division, of application Ser. No. 527,315, filed Nov. 26, 1974, now U.S. Pat. No. 3,908,569.

Latch needles are known in the prior art with a sliding bolt construction. However, the complicated construction required for the manufacture of these sliding bolt needles renders them impractical in commercial utilization.

SUMMARY OF THE INVENTION

An object of this invention is the provision of a novel latched hook needle construction which may be manufactured conveniently utilizing conventional sewing machine needle making tools.

With the above and additional objects and advantages in view, as will hereinafter appear, this invention will now be described in detail with reference to a preferred embodiment illustrated in the accompanying drawings in which.

Figure 1:
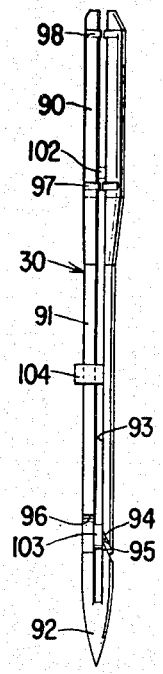
FIG. 1 is an elevational view of the hook needle of this invention looking into the lengthwise groove.
Figure 5:
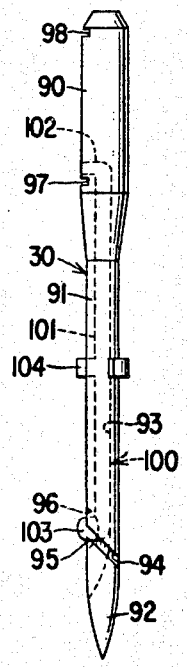
FIG. 5 is an elevational view of the completed needle of this invention taken at right angles to that of FIG. 1.

As shown in FIGS. 1 and 5, a hook needle 30 of this invention is illustrated which comprises a butt portion 90, shank 91 and pointed free extremity 92 having interrelation similar to that of any conventional sewing machine needle. One lengthwise groove 93 is formed opening along one side of the needle and extending continuously from the butt to the pointed free extremity. Near the pointed free extremity the needle shank at one side of the groove 43 is formed with an inclined lateral slot 94 which opens onto the groove 93 to define a thread engaging hook 95. The needle shank at the side of the groove 93 opposite the thread engaging hook 95 is formed with a recess 96 serving to expose the thread engaging hook 95. At the butt 90, the sidewalls of the groove 93 are deformed at two spaced locations 97 and 98 to provide travel stops limiting sliding movement along the groove 93 of a latch member 100.

Figure 2:
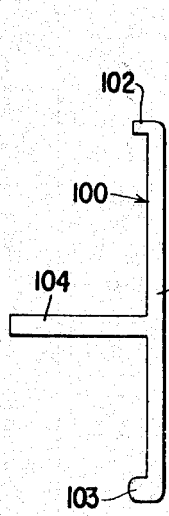
FIG. 2 is an elevational view of the sliding latch for the hook needle as manufactured.

As shown in FIG. 2, the latch member 100 is preferably formed as a sheet metal stamping and includes a lengthwise elongate body portion 101 formed at one extremity with a small lateral extending stop lug 102 and at the other extremity with a laterally extending hook shield 103. Between the ends, the body portion 101 is formed with a lateral extension 104 of considerable length which, as shown in FIG. 5, will ultimately be wrapped around the needle shank to retain the latch member in the needle groove 93.

Figure 3:
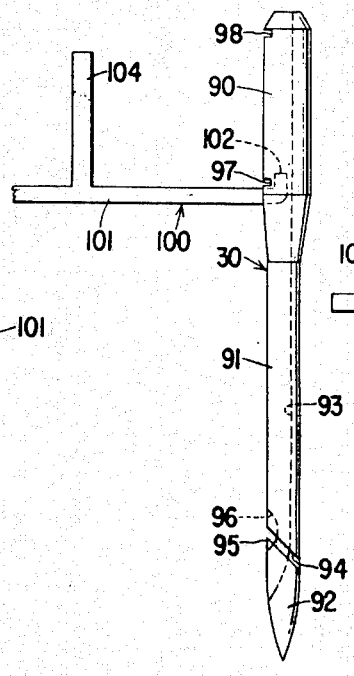
FIG. 3 is an elevational view of the hook needle showing the sliding latch being inserted therein.
Figure 4:
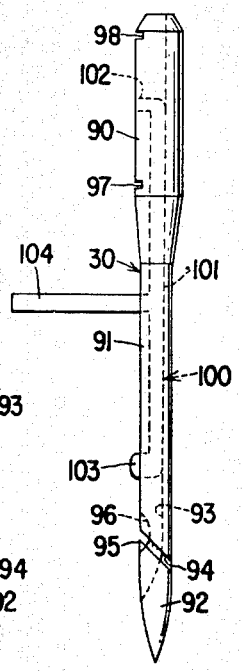
FIG. 4 is an elevational view similar to FIG. 3 but showing the sliding latch positioned completely within the needle groove.

FIGS. 3, 4 and 5 illustrate the manner in which the latch member is assembled into the groove 93 of the hook needle 30. First, the stop lug is inserted into the groove beneath the bottom travel stop 97 with the latch member body arranged at right angles to the needle. The latch member is then turned 90° to position the body portion 101 in the groove with the stop lug arranged between the travel stops. Lastly, the extension 104 is deformed and wrapped loosely around the needle shank 91 to complete the hook needle. It will be noted that the hook shield 103 protrudes slightly out of the groove 93 so that it can be influenced by the passage of the needle into and out of work fabrics to effect relative movement of the latch member along the needle groove to the extent permitted by the travel stops 97 and 98. When the shield 103 occupies a position opposite the hook 95, moreover, the protrusion of the shield out of the groove 93 protects the hook preventing escape of thread loops thereon or inadvertent snagging of other fibers, for instance, fibers of the work fabric. In this position, the shield also serves as a guide to direct off the needle and past the hook any loops of thread which may be engaged thereon.

Having set forth the nature of this invention, what is claimed herein is:

1. A latch needle comprising an elongate body formed with an enlarged butt at one extremity, a shank, and a point at the opposite extremity, said needle body formed with a single continuous lengthwise groove extending from said pointed extremity through said enlarged butt, an inclined groove formed in said needle shank at one side of and intersecting said lengthwise groove to define a thread engaging hook on said needle at the junction thereof, and a latch member slidably arranged in said lengthwise groove, said latch member including a lateral shield projection extending out of said lengthwise groove and movable into and out of a position adjacent to said thread engaging hook, said latch member including a lateral extension formed in spaced relation to said shield projection said lateral extension being deformed into a ring loosely encircling said needle shank after assembly of said latch member into said lengthwise groove.

* * * * *